US008011206B2

(12) United States Patent
Imai

(10) Patent No.: US 8,011,206 B2
(45) Date of Patent: Sep. 6, 2011

(54) CAP AND CAP SYSTEM FOR ORNAMENTS, CHARMS AND ACCESSORIES

(75) Inventor: Stuart Kevin Imai, Redondo Beach, CA (US)

(73) Assignee: Edge Entertainment, Inc., Torrance, CA (US)

( * ) Notice: Subject to any disclaimer, the term of this patent is extended or adjusted under 35 U.S.C. 154(b) by 854 days.

(21) Appl. No.: 11/999,313

(22) Filed: Dec. 3, 2007

(65) Prior Publication Data

US 2008/0245106 A1 Oct. 9, 2008

Related U.S. Application Data

(60) Provisional application No. 60/872,932, filed on Dec. 4, 2006.

(51) Int. Cl.
*A44C 25/00* (2006.01)

(52) U.S. Cl. ..... 63/23; 24/114.4; 24/114.9; 63/33

(58) Field of Classification Search ..... None
See application file for complete search history.

(56) References Cited

U.S. PATENT DOCUMENTS

| | | | | |
|---|---|---|---|---|
| 1,176,619 | A | 3/1916 | Sykes | |
| 3,925,860 | A | 12/1975 | Furuya | |
| 4,535,935 | A | 8/1985 | Spector | |
| 4,757,567 | A | 7/1988 | Booker | |
| 5,673,501 | A * | 10/1997 | Mathews | 36/136 |
| 6,266,853 | B1 * | 7/2001 | Ho | 24/92 |

FOREIGN PATENT DOCUMENTS

| | | | |
|---|---|---|---|
| EP | 1421871 | A2 | 5/2004 |
| FR | 2237592 | A | 2/1975 |

* cited by examiner

*Primary Examiner* — Jack W. Lavinder
(74) *Attorney, Agent, or Firm* — Christie, Parker & Hale, LLP

(57) ABSTRACT

A charm is provided including a body formed from a pliable material including an opening. A first member is at least partly inserted into the opening and is secured to the body. A cap is connected to the first member and is located external of the body. A method for securing such a cap to the charm is also provided.

18 Claims, 4 Drawing Sheets

CAP AND CAP SYSTEM FOR ORNAMENTS, CHARMS AND ACCESSORIES

CROSS REFERENCE TO RELATED APPLICATION

This application is based upon and claims priority on U.S. Provisional Application Ser. No. 60/872,932 filed on Dec. 4, 2006, the contents of which are fully incorporated herein by reference.

BACKGROUND OF THE INVENTION

The present invention is directed to a cap and to a cap system for ornaments, charms and accessories and to ornaments, charms and accessories incorporating such a cap and cap system. Caps used on ornaments, charms accessories and the like (collectively or individually referred to herein as "charm(s)") are typically glued and/or crimped to the outer surface of the charms. For example, with faux or real rabbit's foot charms, the caps are glued directly to the outer fur surface of the rabbit's foot. It is common for the bond between the cap and the outer fur surface to fail prematurely and for the cap to separate from the charm. Consequently, a cap and a cap system are desired that are not subject to early separation from the charms.

SUMMARY OF THE INVENTION

In an exemplary embodiment a charm is provided including a body formed from a pliable material. The body includes an opening. A first member is at least partly inserted into the opening and is secured to the body. A cap is connected tithe first member and is located external of the body. In another exemplary embodiment, the first member is a solid anchor which includes a base, a neck extending from the base and a head extending from the neck. At least a portion of the base is wider than the neck and at least a portion of the head is wider than the neck. The base extends in the body and the head extends out of the body. In yet another exemplary embodiment, the base is sewn to the pliable material body. In a further exemplary embodiment, the pliable material of the body surrounds the neck and is clamped onto the neck. In yet a further exemplary embodiment, a sack is provided surrounding at least the base and is attached to the body. In another exemplary embodiment, an annular disc is retained in the cap. The annular disc includes an annulus which is penetrated by the head such that the disc is located between the base and the head. In another exemplary embodiment, the head is compressible for reducing its transverse dimension for fitting through the annulus of the disc. In yet another exemplary embodiment, the cap includes a post and a tab, and the disc is sandwiched between the post and the tab such that it is retained within the cap. In yet a further exemplary embodiment, the head includes an outer surface and the cap includes an inner surface adhered to the head outer surface. In another exemplary embodiment, the head outer surface includes a plurality of grooves for accommodating an adhesive used to adhere the head surface to the cap inner surface. In another exemplary embodiment, a chord is provided defining a loop. At least a portion of the loop penetrates an opening in the cap and extends external of the cap. The loop includes a first end fitted within a groove formed on the head and a second end fitted within a groove formed on the head. In a further exemplary embodiment, a first stop member extends from the chord first end and includes a first shoulder. A second stop member extends from the chord second end and includes a second shoulder. The first shoulder mates with a third shoulder formed on the head and the second shoulder mates with a fourth shoulder formed on the head, such that the third and fourth shoulders retain the first and second stops, respectively in an axial direction.

In another exemplary embodiment, the first member is a ring defining an annulus and the body surrounds at least a portion of the ring. In yet another exemplary embodiment, a second member extends from the cap. The second member includes a neck portion and a head portion. The neck portion is sized to fit in the ring annulus and at least a portion of the head portion is wider than a diameter of the ring annulus. The head portion penetrates the ring annulus fastening the cap to the first member. In a further exemplary embodiment, the head portion is compressible for reducing its transverse dimension for fitting through the ring annulus. In yet a further exemplary embodiment, a threaded member is provided extending from the cap and threaded to the ring fastening the cap to the ring.

In an exemplary embodiment, the cap is adhered to the first member. In another exemplary embodiment, a loop or a clasp is provided extending from the cap. In a yet another exemplary embodiment, the loop or clasp is fastened to the first member and extends through an opening formed on the cap. In a further exemplary embodiment, the body is formed from a plush material.

DETAILED DESCRIPTION OF THE INVENTION

Figure 1A:
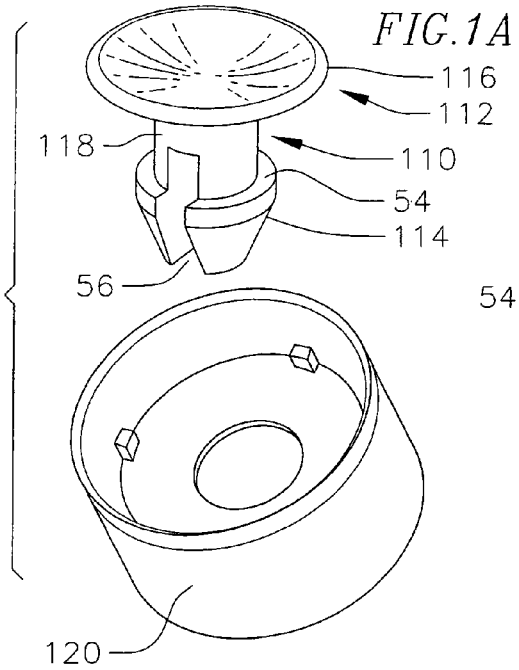
FIG. 1A is an exploded view of an exemplary cap system of the present invention.
Figure 1B:
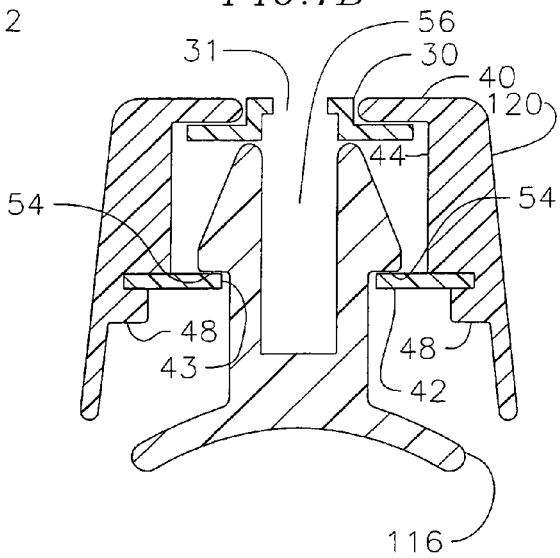
FIG. 1B is a cross-sectional view of an exemplary cap system of the present invention.

The present invention is directed to a cap and to a cap system for ornaments, charms and accessories and to ornaments, charms and accessories (collectively or individually referred to hereinafter as "charm(s)") incorporating such a cap and cap system. While the present invention can be used with various types of charms, made from a pliable material, such as for example a fabric or a plush material among others, it will be described herein for illustrative purposes in relation to a faux rabbit's foot. It should also be noted that the terms "upper," "lower," "over," and "under" as used herein are relative terms used to define relative positions of items. For example, an "upper" item described herein may not always be lower than a "lower" item.

An exemplary cap system includes an anchor which couples with a cap. The anchor is securely attached to the charm 10 and the cap couples with the anchor. In an exemplary embodiment, the anchor is securely attached to the faux rabbit's foot. In an exemplary embodiment, an anchor 110, 210, 310 comprises a base 112, 212, 312 and a head 114, 214, 314 as for example shown in FIGS. 1A, 1B, 2 and 3. In one exemplary embodiment, the base may comprise a foot portion 116, 216, 316 and a neck portion 118, 218 318, as for example shown in FIGS. 1A, 1B, 2 and 3. With this exemplary embodiment, the base 112, 212 312 is inserted into the faux rabbit's foot such that a fur portion 12 of the faux rabbit's foot surrounds the neck portion 118, 218, 318, as for example shown in FIG. 4. A tie or clamp 14 is then used to clamp the fur portion 12 onto the neck portion.

Figure 5:
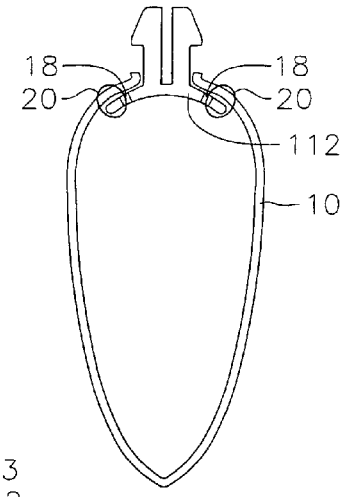
FIG. 5 is a partial cross-sectional view of another exemplary embodiment anchor mounted on a rabbit's foot charm.
Figure 6:
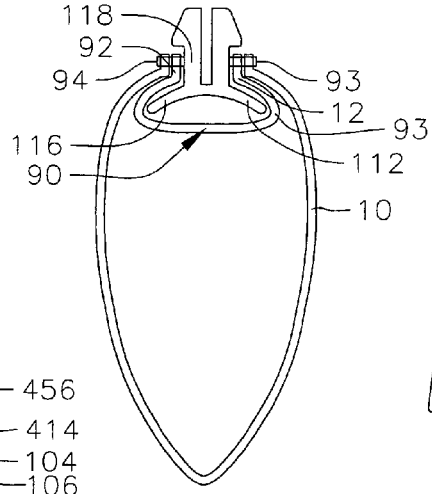
FIG. 6 is a partial cross-sectional view of yet another exemplary embodiment anchor mounted on a rabbit's foot charm.

In another exemplary embodiment, the base foot portion 112, 212, 312 may be provided with openings 18 as for example shown in relation with the foot portion 112 in FIG. 5. With this embodiment, the foot portion is inserted into the faux rabbit's foot and the fur 10 is sewn to the foot portion with stitches 20 that penetrate the openings 18 as for example shown in FIG. 5. In another exemplary embodiment, the base 112 including the neck portion 118 may be encased in a sack 90, as for example shown in FIG. 6. The sack has a mouth 92 surrounding the neck portion 118 and a main portion 93 surrounding the foot portion 116 of the anchor. The mouth has a dimension, e.g., a diameter, smaller than a dimension, e.g., a diameter, of the foot portion such that the foot portion is retained within the sack main portion and cannot be extruded from the sack mouth without breaking or tearing up the sack. The anchor with sack are then inserted into the faux rabbit's foot such that a fur portion 12 of the rabbit's foot surrounds the sack mouth and anchor neck portion. The fur portion 12 is then stitched with stitches 94 to the mouth 92 of the sack, as for example shown in FIG. 6. The sack may be made from any material such as for example, a fabric material. In yet another further exemplary embodiment, the foot portion of the base of the anchor may be glued onto the inner portion of the faux rabbit's foot, as for example the inner surface of the fur. In an exemplary embodiment, the foot portion may be formed with depressions 22 (FIG. 2) to accommodate the adhesive for providing a stronger bond.

Figure 2:
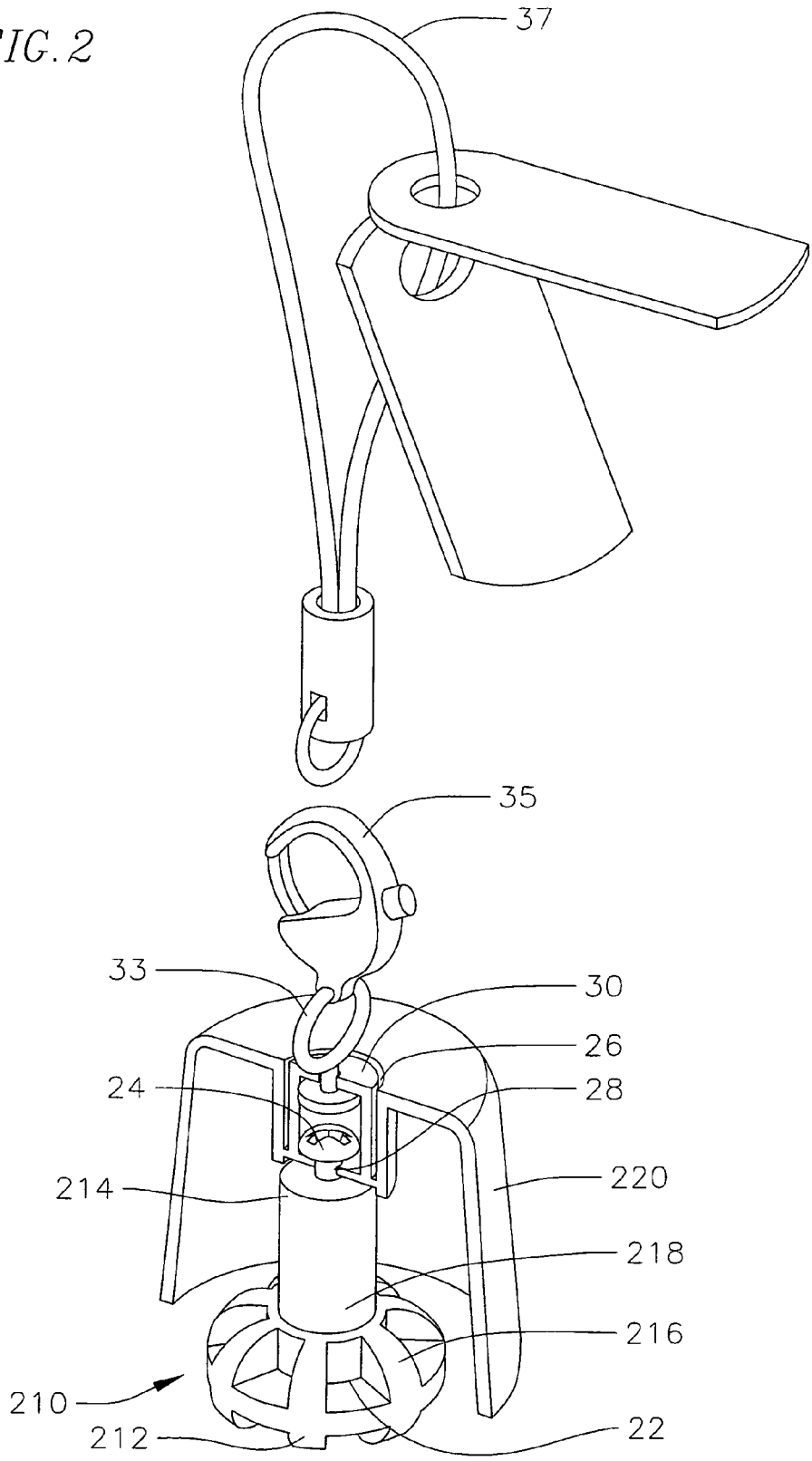
FIG. 2 is a partial cutaway perspective view of another exemplary embodiment cap system of the present invention.

In one exemplary embodiment, as shown in FIG. 2, a cap 220 is fastened to the head portion 214 of the anchor using a fastener 24 such as a screw. In the shown exemplary embodiment, the cap has a depression 26 and an opening 28 that is penetrated by the fastener for fastening the cap to the anchor 210 which is connected to the faux rabbit's foot. A plug 30 may then be press fitted into the depression 26. In the exemplary embodiment, a clasp 32 may be attached to the plug 30. The clasp 32 may be coupled to a ring 33 which is coupled to the plug 30. A loop 34 may be coupled to the clasp as shown in FIG. 2. The clasp may be used for attaching the faux rabbit's foot to other devices, as for example a cell phone, a purse, a key, etc.

Figure 1C:
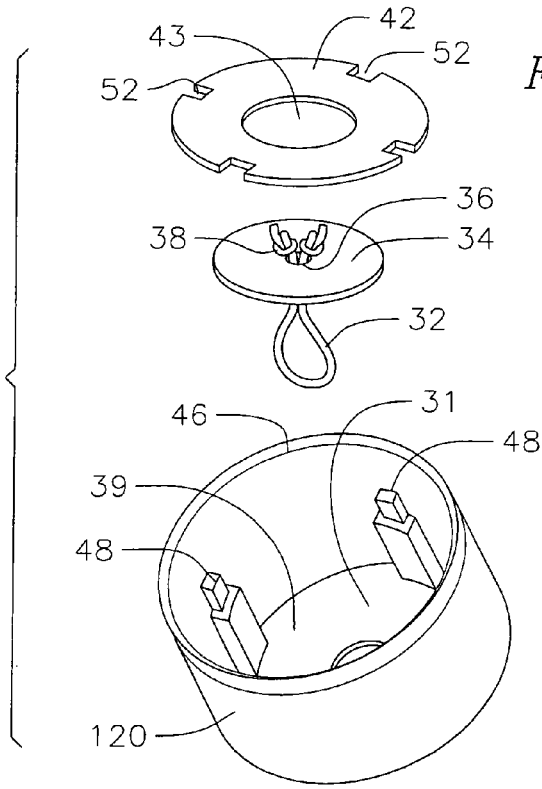
FIG. 1C is a perspective exploded view of a cap of the present invention.

In another exemplary embodiment, a cap 120 is provided having an opening 31 (FIGS. 1A and 1C). A cord 32 is attached to a washer 34 having an external diameter larger than the diameter of the opening 31. In the exemplary embodiment shown in FIGS. 1A and 1C, the washer 34 has a small opening 36 which is penetrated by the two ends of the cord 32, such that the cord forms a loop. A knot 38 is formed at each end of the cord to prevent the ends from being extruded through the washer. The washer is fitted into the cap such that the cord loop penetrates the cap opening 31 and extends beyond the opening. In an exemplary embodiment, the washer 34 may be "hat" shaped in cross-section as for example shown in FIG. 1B such that when the washer is mated against an end 39 of the cap defining the opening 31, a projecting portion 38 of the washer defining the "hat" penetrates the opening and is flush with an outer surface 40 of the cap.

In an exemplary embodiment, an annular plate 42 having a central opening 43 is fitted into the cap and is spaced apart from the cap end 39. The plate may be glued or otherwise fastened to the cap. In an exemplary embodiment, the cap is provided with posts 44 formed on its inner surface 46. Tabs 48 extend over the posts 44. In the exemplary embodiment, the annular plate is formed with cut-outs 52. The annular plate is mounted on the cap such that each cut-out slides over a corresponding tab. As such, the cut-outs serve to guide the annular plate into the proper position. The tabs are then compressed generally axially against the annular plate such that the tab material permanently deforms and extends over the annular plate so as to securely retain the annular plate in position. In this regard, the annular plate is sandwiched between the posts 44 and corresponding compressed tabs 48, as for example shown in FIG. 1B. The tabs may be compressed using a press which can apply pressure against all tabs simultaneously or individually.

With this exemplary embodiment, an anchor 110 is used having a head portion 114 which tapers from a larger outer diameter to a smaller outer diameter in a direction away from the base 112 as for example shown in FIGS. 1A and 1C. The head diameter adjacent the neck portion is larger than the diameter of the neck portion defining a shoulder 54 on the head adjacent the neck portion. A slot 56 is formed through the head portion 114 such that the head can be transversely compressed. The larger diameter portion of the head has a diameter greater than the diameter of the annular plate opening 43.

To attach the cap to the anchor, the cap is pushed over the anchor such that the anchor head 114 tries to penetrate the annular plate opening 43. When this occurs, the anchor head 114 is compressed transversely by the annular plate opening 43 collapsing the slot 56, allowing the larger diameter portion of the head to penetrate the opening 43. When the head completely penetrates the opening 43, the head expands to its original shape such that the shoulder 54 extends over the annular plate, preventing the head from being extruded from the annular plate as for example shown in FIG. 1B. When this occurs, the annular plate securely retains the anchor within the cap.

In another exemplary embodiment, rather than using a washer to attach the cord, the cord may be made part of a plug that is fitted through the opening 31 of the cap and may be attached to the anchor, either by an adhesive or by a fastener that penetrates the plug and fastens onto the anchor.

Figure 3:
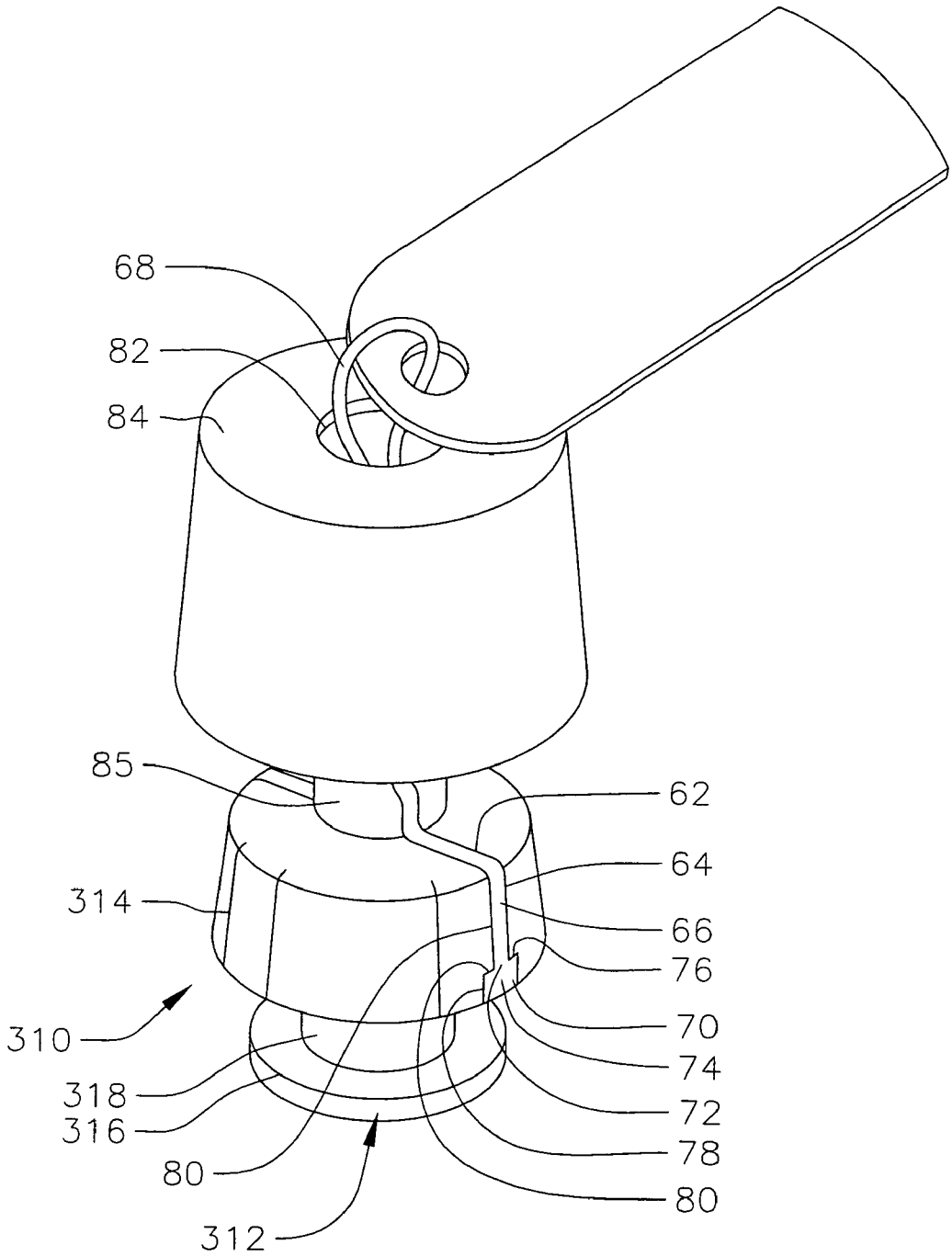
FIG. 3 is an exploded view of yet another exemplary embodiment cap system of the present invention.
Figure 4:
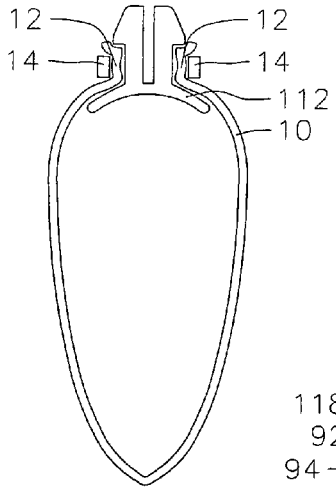
FIG. 4 is a partial cross-sectional view of an exemplary embodiment cap system anchor mounted on a rabbit's foot charm.

In yet another exemplary embodiment, the head portion 314 of the anchor 310 may be provided with a surface having sufficient dimensions such that it fits snuggly within the cap inner surface as for example shown in FIG. 3. With this embodiment, the head portion may be glued using an appropriate adhesive to the cap inner surface. In an exemplary embodiment, the head portion 314 of the anchor is provided with grooves as for example axial grooves 60 to accommodate the adhesive and to allow for the flow of adhesive to provide for a stronger bond between the head and the cap.

In yet a further exemplary embodiment as shown in FIG. 3, the head may be provided with a diametrical groove 62 extending axially along the periphery 64 of the anchor head and diametrically across the head for accommodating a cord 66 which forms a loop 68. In the exemplary embodiment shown in FIG. 3, each cord 66 end then is fitted with a stop 70. In the exemplary embodiment shown in FIG. 3, the stop has a narrow width portion 72 which is coupled to the cord 66 and a larger width portion 74 extending from the narrow width portion defining shoulders 76 extending from the narrow width portion. The diametrical groove 62 at each of its ends on the peripheral surface of the anchor head has a wider portion 78 defining a shoulder 80. The wider portions 78 of the groove are wider than the wider portions of the stops. The wider portions of the stops are fitted into the wider portion of the groove such that the shoulders 76 on the stops mate with the shoulders 80 on the groove retaining the stops from moving axially in an upward direction along the groove on the anchor head peripheral surface. A portion of the cord may then be fitted into the diametrical groove, as for example shown in FIG. 3. The loop 68 defined by the cord is extended through an opening 82 formed on the cap upper surface 84 as the cap is slid over the anchor head for being adhered thereto. In this regard, the loop extends outward from the cap. The anchor head may be formed with a projection 85 which penetrates the opening 82 of the cap when the cap is mated to the anchor head. In the exemplary embodiment shown in FIG. 3, the groove 62 extends axially along two opposite locations on the projection and does not extend diametrically across the projection. In another exemplary embodiment, the groove 62 may extend both axially and diametrically across the projection or may not extend to the projection.

Figure 7:
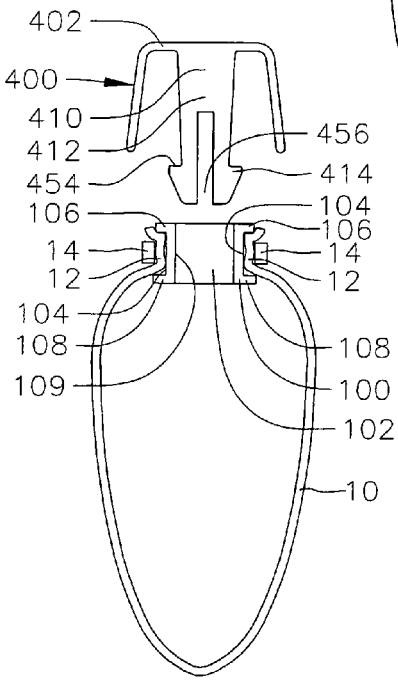
FIG. 7 is a partial cross-sectional exploded view of a further exemplary embodiment cap system of the present invention.

In an alternate exemplary embodiment, a ring 100 having a central opening 102 and an outer surface defining an annular channel 104 is positioned within rabbit's foot faux fur, such that a portion 12 of the faux fur surrounds the annular channel 104, as for example shown in FIG. 7. The channel 104 is defined by upper and lower annular walls 106 and 108 respectively, extending radially outwardly from a body 109 of the ring. A tie or clamp 14 is used to tie or clamp the fur portion within the annular channel 104, securing the ring 100 to the faux fur. With this embodiment, a cap 400 is used having an anchor 410 extending downward from an upper wall 402 of the cap. The cap anchor has a head portion 414 extending from a neck portion 412. The head portion 414 tapers from a larger outer diameter to a smaller outer diameter in a direction away from the cap wall 402 as for example shown in FIG. 7. The head diameter adjacent the neck portion is larger than the diameter of the neck portion defining a shoulder 454 on the head adjacent the neck portion. A slot 456 is formed through the head portion 414 such that the head can be transversely compressed. The larger diameter portion of the head has a diameter greater than the diameter of the ring opening 102.

To attach the cap with anchor to the ring, the cap is pushed over the ring 100 such that the cap anchor head 414 tries to penetrate the ring opening 102. When this occurs, the cap anchor head 414 is compressed transversely by the ring opening 102 collapsing the slot 456, allowing the larger diameter portion of the head to penetrate the ring opening 102. When the head completely penetrates the ring opening 102, the head expands to its original shape such that the shoulder 454 extends under the ring body 109 and/or wall 108, preventing the cap anchor from being extruded from the ring 100, as for example shown in FIG. 7. When this occurs, the cap is secured to the faux rabbit's foot.

Figure 8:
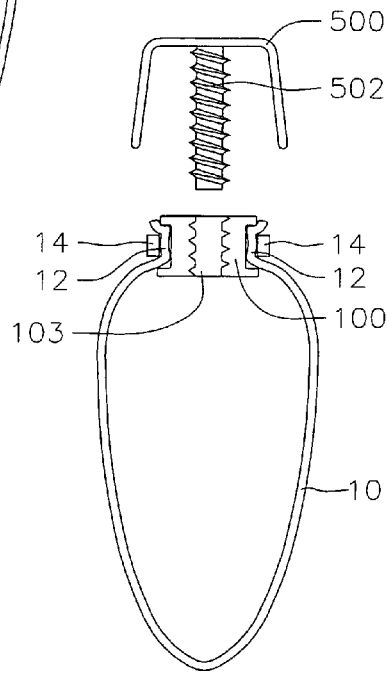
FIG. 8 is a partial cross-sectional exploded view of yet a further exemplary embodiment cap system of the present invention.

In another exemplary embodiment, the ring 100 has a threaded opening 103, instead of the opening 102, as for example shown in FIG. 8. The ring is secured to the faux fur as for example described in relation to FIG. 7. A cap 500 is provided with an anchor in the form of a fastener 502 extending from the cap, as for example shown in FIG. 7. The cap is fastened to the ring by threading the fastener 502 to the threaded opening 103.

With either of the aforementioned exemplary embodiments, a clasp may be attached directly to the head, or to a ring or to a loop. In yet other exemplary embodiments, a clasp or a ring may be used in lieu of a loop. Furthermore, with either of the aforementioned exemplary embodiments, the cap and/or anchor may be made from metallic, plastic or composite materials. Moreover, the cap system securing mechanisms may be reversed. For example, the anchor may extend from the cap and not from a component directly attached to the faux fur. The present invention in exemplary embodiments provides for the anchoring of a cap to a charm, as for example the anchoring of a cap to a faux rabbit's foot fur charm, thereby providing for a method and a system for securely attaching a cap to a charm.

Although limited exemplary embodiments of the cubic press anvil have been specifically described and illustrated herein, many modifications and variations will be apparent to those skilled in the art. Accordingly, it is to be understood that the cubic press anvil constructed according to principles of this invention may be embodied other than as specifically described herein. The invention is also defined in the following claims.

The invention claimed is:

1. A charm comprising:

a body formed from a pliable material and comprising an opening;

a first member having at least a portion inserted into the opening, said first member being secured to the body;

a cap connected to the first member, wherein said cap is external of said body, wherein the first member is a solid anchor, said anchor comprising a base, a neck extending from the base and a head extending from the neck, wherein at least a portion of the base is wider than the neck and wherein at least a portion of the head is wider than the neck, wherein the base extends in the body and wherein the head extends out of the body; and an annular disc retained in the cap, wherein said annular disc comprises an annulus, wherein said head penetrates said annulus, wherein said disc is located between said base and said head.

2. The charm as recited in claim 1 wherein said base is sewn to said pliable material body.

3. The charm as recited in claim 1 wherein the pliable material of the body surrounds the neck and is clamped onto said neck.

4. The charm as recited in claim 1 further comprising a sack surrounding at least said base, wherein said sack is attached to said body.

5. The charm as recited in claim 1 wherein the head is compressible for reducing its transverse dimension for fitting through said annulus.

6. The charm as recited in claim 1 wherein said cap comprises a post and a tab, wherein said disc is sandwiched between the post and the tab for being retained within said cap.

7. The chasm as recited in claim 1 wherein said head comprises an outer surface, wherein said cap comprises an inner surface and wherein said head outer surface is adhered to said cap inner surface.

8. The charm as recited in claim 7 wherein said head outer surface comprises a plurality of grooves for accommodating an adhesive used to adhere said head surface to said cap inner surface.

9. The charm as recited in claim 7 further comprising a chord defining a loop, wherein at least a portion of said loop penetrates an opening in said cap and extends externally of said cap, wherein said loop comprises a first end fitted within a groove formed on the head and a second end fitted within a groove formed on the head.

10. The charm as recited in claim 9 further comprising a first stop member extending from said first end and comprising a first shoulder and a second stop member extending from said second end and comprising a second shoulder, wherein said first shoulder mates with a third shoulder formed on the head and said second shoulder mates with a fourth shoulder formed on the head, wherein said third and fourth shoulders retain said first and second stops, respectively in an axial direction.

11. The charm as recited in claim 1 wherein said first member is a ring defining an annulus, wherein said body surrounds at least a portion of said ring.

12. The charm as recited in claim 11 further comprising a second member extending from said cap, said second member comprising a neck portion and a head portion, wherein the neck portion is sized to fit in said annulus and wherein at least a portion of said head portion is wider than a diameter of said annulus, wherein the head portion of the second member penetrates said ring annulus fastening said cap to said first member.

13. The charm as recited in claim 12 wherein the second member head portion is compressible for reducing its transverse dimension for fitting through said annulus.

14. The charm as recited in claim 11 further comprising a threaded member extending from said cap and threaded to said ring fastening the cap to said ring.

15. The charm as recited in claim 1 wherein the cap is adhered to the first member.

16. The charm as recited in claim 1 further comprising at least one of a loop or clasp extending from said cap.

17. The charm as recited in claim 16 wherein said at least one loop or clasp is fastened to said first member and extends through an opening formed on said cap.

18. The charm as recited in claim 1 wherein said body is formed from a plush material.

* * * * *